United States Patent [19]

Salgó

[11] Patent Number: 4,799,912

[45] Date of Patent: Jan. 24, 1989

[54] METHOD AND APPARATUS FOR PRODUCING DISCHARGE TUBES FOR SODIUM VAPOR LAMPS

[75] Inventor: Tamás Salgó, Budapest, Hungary

[73] Assignee: Tungsram Rézvénytársaság, Budapest, Hungary

[21] Appl. No.: 6,210

[22] Filed: Jan. 23, 1987

[30] Foreign Application Priority Data

Feb. 12, 1986 [HU] Hungary ..... 596/86

[51] Int. Cl.[4] ..... H01J 9/395; H01J 9/40

[52] U.S. Cl. ..... 445/26; 445/43; 445/70

[58] Field of Search ..... 445/26, 73, 70, 43, 445/45, 44, 40

[56] References Cited

U.S. PATENT DOCUMENTS

| | | | |
|---|---|---|---|
| 2,985,129 | 5/1961 | Kirkpatrick | 228/219 X |
| 3,853,374 | 12/1974 | Flasche et al. | 445/40 |
| 4,166,563 | 9/1979 | Peyraud et al. | 445/70 X |
| 4,344,468 | 8/1982 | Sandberg | 141/314 X |
| 4,532,970 | 8/1985 | Tullis et al. | 141/98 |
| 4,746,316 | 5/1988 | Sudo et al. | 445/43 |

FOREIGN PATENT DOCUMENTS 178880 11/1981 Hungary .

*Primary Examiner*—Kenneth J. Ramsey
*Attorney, Agent, or Firm*—Schweitzer & Cornman

[57] ABSTRACT

The invention relates to a process and apparatus for the manufacture of an aluminum discharge lamp for sodium vapor lamps, wherein all manufacturing steps are carried out within a glove box having a protective atmosphere in its interior and all components and apparatus required for the manufacture of the aluminum discharge tube are disposed within the glove box and the protective atmosphere within.

7 Claims, 1 Drawing Sheet

METHOD AND APPARATUS FOR PRODUCING DISCHARGE TUBES FOR SODIUM VAPOR LAMPS

FIELD OF THE INVENTION

The present invention relates to a method of and apparatus for producing discharge tubes for sodium vapor lamps.

BACKGROUND OF THE INVENTION

Sodium vapor discharge lamps are one of the most significant products of lighting industry. due to their outstanding specific lumen/watt performance ratio they are becoming increasingly popular in energy saving public lighting applications. The expectable life of lamps of the type produced at the present time does not exceed 10 to 15 thousand hours, depending on the type involved. Because of the high cost of such lamps an ever increasing life expectancy is demanded by the market, reaching or even exceeding 20 to 25 thousand service hours, for the reduction of operating costs.

According to the known manufacturing technology for sodium vapor lamps, such as is described in Hungarian patent specification No. 178,880, first one end of a discharge tube is sealed in a vacuum furnace. Then the discharge tubes are transferred into a high-purity glove box in which the adding of dopants takes place. After doping, the tubes are re-transferred into the vacuum furnace, where they are filled with gas and the other ends of the tubes are sealed. This method is used in the case of discharge tubes which have no suction pipes attached to them. The manufacturing method is also similar in the case of discharge tubes with attached suction pipes, but with the difference that the dopants are added only after both ends were sealed and the pumping, gas filling and shutting-off steps are then performed in a multi purpose apparatus. The sequence of manufacturing steps and the design of the sealing furnaces and pumps depend on the specific model of the discharge tube, such as is described, for example, in U.S. Pat. Nos. 3,363,133; 3,363,143; and 3,609,437.

All known methods for making gas discharge tubes have a common feature that the discharge tubes are exposed several times to the free atmosphere during the intervals between various manufacturing steps. It is a recognized fact that the most important factor that affects useful life of lamps is the purity of their gas filling (i.e. partial pressure of water and of oxygen) in the discharge tube. The gas purity obtainable with currently known manufacturing technologies, i.e. the transfer of tubes in air between operations is unsatisfactory because the average oxygen and water concentration being in the range of 100 to $500\times10^{-6}$ g/g, whereas to increase useful life and reliable production the internal gas purity should be kept below an average concentration of $10\times10^{-6}$ g/g.

BRIEF DESCRIPTION OF THE INVENTION

An object of the present invention is to provide a process and apparatus by means of which discharge tubes can be manufactured continuously, reliably and free of all expectable external influences, such as variation of humidity, lack of technological discipline with the above mentioned desirable gas purity.

This object is accomplished by the invention by locating the entire manufacturing process under a closed pure protective inert gas atmosphere. Thus, the discharge tubes are not exposed to the external atmosphere while being transferred from one manufacturing operation to the other and the tubes are kept constantly under the protective gas atmosphere throughout the entire manufacturing process.

Correspondingly the present invention provides a manufacturing method for discharge tubes for sodium vapor lamps, comprising the steps of sealing the accessories, such as end plugs, electrodes, current lead-in members, suction pipe, etc. into the ends of the alumina discharge tube, introducing the dopants such as Na-Hg-mixture, evacuating the tube, introducing a gas filling such as Xenon, and sealing the discharge tube. In this process the discharge tubes are transferred from one step to the next such as in the sequence of component sealing, introducing of dopants, pumping, etc. all in a closed space filled with high-purity inert gas. The invention also relates to apparatus suitable to carry out the aforementioned method. The apparatus involves a glove box containing a high-purity inert gas in its interior. The furnace for sealing and the first and second ends of the tube, the doping spare and the combined pumping filling and sealing head are attached to the glove box.

DESCRIPTION OF THE DRAWING

The invention described with reference being had to the attached sole FIGURE of the drawing, which is a schematic diagram of the apparatus of the present invention.

DESCRIPTION OF A PREFERRED EMBODIMENT

Figure 1:
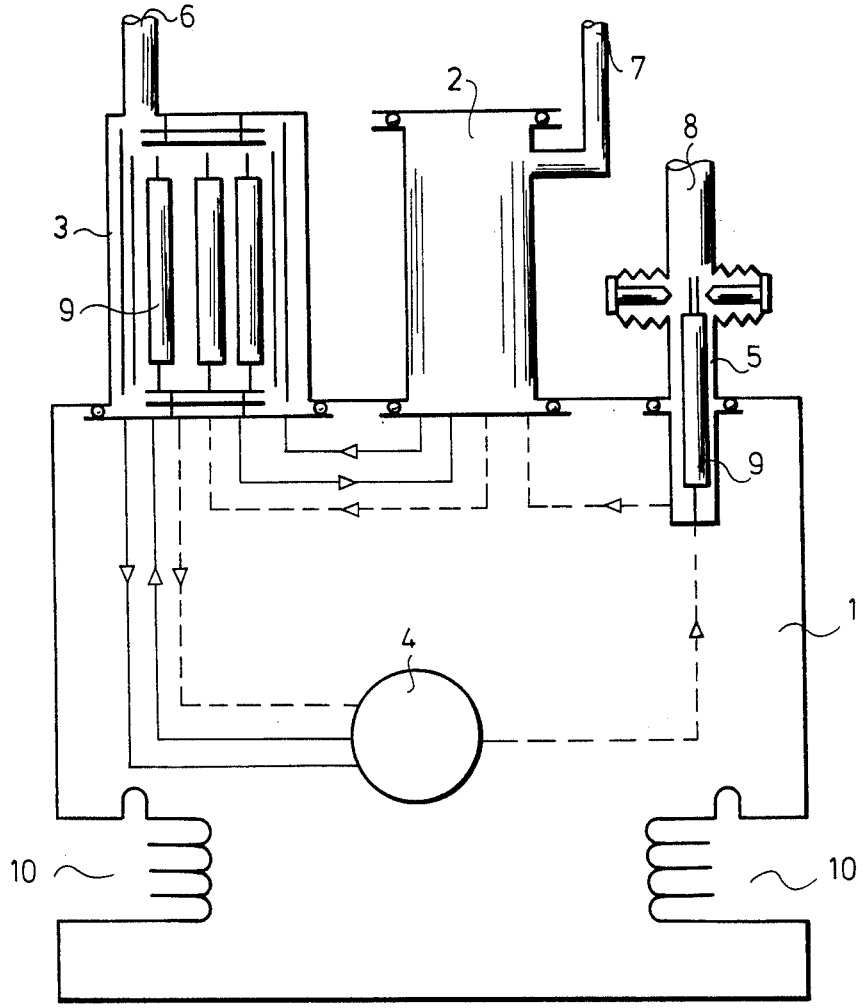

A closed space 1 is filled with a high purity inert gas. A lock chamber 2, a vacuum furnace 3, a space 4 for introducing the dopants, a combined pumping, filling and sealing-off head 5, a stub 6 for connecting the vacuum and gas filling systems, a first connecting stub 7 for the sluicing valve system, a second connecting stub 8 for the vacuum and gas filling systems, a discharge tube 9, and a pair of manipulating gloves 10 are provided as explained below.

The production of the discharge tube 9 is started by inserting the components through the lock chamber 2, into the closed space 1. The closed space is filled with a high purity inert gas. During manufacturing operations, the discharge tube 9 is maintained within this confined space 1 and is brought into the free atmosphere through the lock chamber 2 only after having been completely sealed off. Thereby, the gas filling of discharge tube 9 and the final gas contamination of the dopants can be safely prevented from exceeding the predetermined contamination level of $10\times10^{-6}$ g/g.

High purity production according to the present invention is carried out in the apparatus shown in the drawing. The apparatus comprises a high purity glove box, with its closed inner gas space 1 being filled with an inert gas to atmospheric pressure and containing a combined water and oxygen contamination of less than $10\times10^{-6}$ g/g throughout the entire manufacturing process. The parts passing in and out of the glove box are prevented by the gating action of the lock chamber 2 from bringing with them contaminants into the closed space 1 which contains the inert gas of high purity. The first and second tube end are sealed off in the vacuum furnace 3. In the case of discharge tubes having no suction tube also the gas filling is performed here. In the space 4 the dopants such as a Na-Hg mixture are filled into the discharge tube 9. In the filling and sealing head 5 there are performed the pumping, the filling with inert gas such as with Xenon, and the sealing operation of the discharge tubes 9.

The lock chamber 2, the vacuum furnace 3 and the internal space of the combined pumping, filling and sealing head 5 open into the closed space 1 that is filled with the high purity inert gas. Thereby it is insured that in the periods between the consecutive manufacturing steps the discharge tubes 9 are disposed only within the closes space 1 that contain the high purity inert gas.

The path of the discharge tubes 9 without suction pipe is shown in the drawing by a continuous line, while the path of those fitted with suction pipe is indicated by a broken line.

By a comparison between discharge tubes of sodium vapor lamps made by the method and apparatus of the present invention and similar tubes of identical rating (250 W) and made of similar structural materials and using the same dopants, manufactured in a conventional manner, a definite and unambiguous difference has been found between the purities of the gaseous content of the two types of discharge tubes.

The measurements were carried out by means of a mass spectograph after breaking the respective tubes. In the conventionally made discharge tubes their internal water contamination varied in the range of 50 to $300\times10^{31\ 6}$ g/g. Characteristically, a large scattering in the contamination figures could be observed even between discharge tubes made according to the prior art and taken from the same batch. Discharge tubes manufactured according to the method, and with the apparatus of the present invention, contamination figures between 5 and $10\times10^{-6}$ g/g have been found, with extreme uniformity and reliability.

I claim:

1. In a process for the manufacture of an alumina discharge tube for sodium vapor lamps, wherein an end plug electrode and a current lead in conductor are first sealed into the discharge tube, dopant additive is introduced into the discharge tube, then the discharge tube is evacuated, then is filled with a gas, and is then second sealed, wherein the improvement comprises conveying said discharge tube between separate areas within an enclosable space for carrying out each of said steps of first sealing, introducing, evacuating, filling, and second sealing, said conveying being all carried out in an atmosphere of pure inert gas which is in common connection with each of said areas.

2. The improvement in the process of claim 1, wherein said pure insert gas contains a combined water and oxygen content of less than $10\times10^{-6}$ *g/g*.

3. The process of claim 1, wherein said dopant additive is a mixture of sodium and mercury.

4. The process of claim 1, wherein said filling gas is Xenon.

5. The process of claim 1, wherein an end plug electrode, a current lead in conductor, and a suction tube are first sealed into the discharge tube.

6. Apparatus for the manufacture of an alumina discharge tube for a sodium vapor lamp, comprising a glove box having a closed interior space for containing a high purity inert gas under constant pressure, and as separate units within said closed interior space there are disposed (a) a vacuum furnace for sealing the ends of the discharge tube, (b) a space for the introduction of a dopant into the discharge tube, and (c) a combined pumping, filling and sealing off head for pumping out the contents of the discharge tube and for filling the discharge tube with a filling gas.

7. The apparatus of claim 6, further comprising a lock chamber for the introduction of alumina discharge tubes into the closed interior of the glove box.

* * * * *